US006877847B2

(12) United States Patent
Hayashi et al.

(10) Patent No.: US 6,877,847 B2
(45) Date of Patent: Apr. 12, 2005

(54) INK TANK

(75) Inventors: Hiroki Hayashi, Kanagawa (JP); Yasuo Kotaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/136,394

(22) Filed: May 2, 2002

(65) Prior Publication Data

US 2003/0016279 A1 Jan. 23, 2003

(30) Foreign Application Priority Data

May 10, 2001 (JP) ..... 2001-140065
Apr. 26, 2002 (JP) ..... 2002-125612

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | | |
|---|---|---|---|---|---|
| 5,489,932 | A | * | 2/1996 | Ceschin et al. | 347/87 |
| 5,567,373 | A | | 10/1996 | Sato et al. | 264/112 |
| 5,589,862 | A | | 12/1996 | Ujita et al. | 347/87 |
| 5,815,184 | A | | 9/1998 | Ujita et al. | 347/89 |
| 5,841,455 | A | | 11/1998 | Tanaka et al. | 347/87 |
| 6,137,512 | A | * | 10/2000 | Higuma et al. | 347/86 |
| 6,382,783 | B1 | | 5/2002 | Hayashi et al. | 347/85 |
| 6,419,350 | B1 | | 7/2002 | Abe et al. | 347/86 |
| 6,450,631 | B1 | | 9/2002 | Hayashi et al. | 347/86 |
| 6,502,931 | B2 | | 1/2003 | Udagawa et al. | 347/86 |
| 6,505,923 | B1 | | 1/2003 | Yamamoto et al. | 347/85 |
| 6,540,342 | B2 | | 4/2003 | Koshikawa et al. | 347/86 |
| 6,550,898 | B2 | | 4/2003 | Hayashi et al. | 347/85 |

FOREIGN PATENT DOCUMENTS

| | | | | |
|---|---|---|---|---|
| EP | 711667 | | 5/1996 | |
| EP | 771662 | | 5/1997 | |
| EP | 894630 | | 2/1999 | |
| EP | 956959 | | 11/1999 | |
| EP | 960732 | | 12/1999 | |
| EP | 1020293 | | 7/2000 | |
| EP | 1025998 | | 8/2000 | |
| EP | 1053876 | | 11/2000 | |
| EP | 1080913 | | 3/2001 | |
| JP | 05-104735 | * | 4/1993 | B41J/2/175 |
| JP | 9-174867 | | 7/1997 | |
| JP | 10-235887 | * | 9/1998 | B41J/2/175 |
| JP | 2000-33715 | | 2/2000 | |
| KR | 1999-088164 | | 12/1999 | |

* cited by examiner

*Primary Examiner*—Anh T. N. Vo
(74) *Attorney, Agent, or Firm*—Fitzpatrick, Cella, Harper & Scinto

(57) ABSTRACT

There is disclosed an ink tank in which an ink holding member is inhibited from being excessively deformed, and which steadily supplies an ink. A foaming direction of urethane of a first ink holding member is disposed substantially vertically (arrow B) to an abutment direction of an ink jet head onto an ink receiving tube so that the member is easily deformed with respect to a press force of a pressing direction (arrow A) substantially parallel to the abutment direction onto the ink receiving tube 34B, and the foaming direction of urethane of a second ink holding member is disposed in a direction substantially parallel to (arrow C) the abutment direction onto the ink receiving tube so that the member is not easily deformed with respect to the press force of the pressing direction substantially parallel to the abutment direction onto the ink receiving tube.

5 Claims, 7 Drawing Sheets

INK TANK

BACKGROUND OF THE INVENTION

1. Field of the Invention

The present invention relates to an ink tank which is constituted to be attachable/detachable with respect to a recording head mounted on an ink jet recording apparatus, generally to an ink tank in which an ink tank size of a direction substantially vertical to an abutment direction is small with respect to an ink tank size of the abutment direction onto an ink supply tube of an ink jet head, and in which a so-called aspect ratio is high with respect to the abutment direction onto the ink jet head, particularly to an inventive and improved ink tank in which the constitution of an ink absorbing material contained in the ink tank is defined, a defect is inhibited from being generated in an internal structure by an external factor, and a stable ink supply capability can be fulfilled.

2. Description of the Related Art

In a field of ink jet recording, in a constitution in which an ink jet head is united with an ink tank from viewpoints of miniaturization of an apparatus and a maintenance-free apparatus, it is known that an ink jet cartridge set to be attachable/detachable with respect to a mounting portion (scanning carriage) of an ink jet recording apparatus is used. In the ink jet cartridge, for example, a constitution in which the ink jet head is constantly united with the ink tank, and a constitution in which the ink jet head and ink tank are attachable/detachable and united during the use are known to be used.

The ink tank for use in the ink cartridge is required to steadily hold an ink so that the ink does not leak to the outside in an unused state for recording, and to steadily supply the ink to the ink jet head during the recording. To satisfy this requirement, the ink tank includes a constitution for generating a back pressure against a flow of ink supplied to the ink jet head, that is, a so-called negative pressure.

Examples of a general constitution for generating the negative pressure in the ink tank include an constitution described in Japanese Patent Application Laid-Open Nos. 62-264728 and 8-230207 in which a porous material such as urethane foam is contained as a negative pressure generating member (ink absorbing material) in the ink tank, and a capillary force of the porous material is used as a negative pressure generation source. The ink tank for use in the constitution usually includes: an ink container in which an ink absorbing material for storing the ink is contained; an ink supply port for supplying the ink to the ink jet head from the ink absorbing material; and an atmosphere communicating port for taking atmospheric air into the ink container in order to smoothen ink supply during the recording.

Moreover, in order to steadily supply the ink to the ink jet head, the ink absorbing material is contained inside the ink tank in such a manner that an ink holding force in the ink supply port of the ink tank and a periphery of the port is high as compared with other regions. Furthermore, a condition is generally constituted such that the ink easily gathers in the vicinity of the ink supply port.

Examples of a method for raising the capillary force include a method, described in the Japanese Patent Application Laid-Open No. 8-230207, comprising: containing ink holding members (ink absorbing materials) including a first ink holding member 250 for collecting the ink in the vicinity of the ink supply port to an ink jet head 232 and a second ink holding member 251 for holding the ink in a housing 211 of an ink tank 210 as shown in FIG. 7A; setting the ink holding force (capillary force) of the first ink holding member 250 to be not less than the capillary force of the second ink holding member 251; and allowing the first ink holding member 250 to constantly hold the ink so that the ink is steadily supplied. This system is generally known. For example, a constitution is known in which an urethane ink absorbing material is used in the second ink holding member 251 and the ink holding member formed of a fiber bundle is used in the first ink holding member 250.

The first ink holding member 250 is constituted of the bundle of fibers arranged along an ink supply direction. As shown in FIG. 7B, when the ink tank 210 is mounted onto the ink jet head 232, in order to allow an ink receiving tube 234B on an ink jet head 232 side to firmly abut on the first ink holding member 250, the first ink holding member 250 slides towards the second ink holding member 251, and pushes inwards the second ink holding member 251 so as to compress the second ink holding member in this mode.

In the above-described mode, the first ink holding member 250 formed of the fiber bundle is constituted by compressing the fibers with a high pressure, and is therefore hard and is not easily deformed as compared with the second ink holding member 251 formed of urethane. Therefore, when the ink receiving tube 234B is inserted via the supply port of the ink tank, the first ink holding member 250 slides, this sliding is absorbed by the deformation of the second ink holding member 251, and a restoring force of the second ink holding member 251 is used to achieve stable abutment among the ink receiving tube 234B, first ink holding member 250, and second ink holding member 251.

Additionally, since the ink tank is contained/held in the ink jet recording apparatus, an outer shape of the ink tank is sometimes determined as a requirement on the ink jet recording apparatus side. Therefore, there has been a demand for not only an ink tank in which an aspect ratio is balanced but also an ink tank which is longer than is wide, a thin ink tank, and the like.

The ink tank is attached/detached with respect to the ink jet head. Therefore, for example, an operator drops the ink tank in handling the ink tank, or another rapid external impact is sometimes applied to the ink tank.

When a large external impact is added, the second ink holding member 251 occupying a large volume in the ink tank sometimes moves and is deformed in the ink tank. The slightly deformed ink holding member can be restored by elasticity thereof, but the member is not restored depending on a degree of deformation. The ink holding force rises in a deformed portion, the ink remains in the corresponding portion, and a drop of ink consumption efficiency might be caused. Moreover, there is also a possibility that ink leak is caused.

Particularly, in recent years, an amount of ink held in the ink tank so that the tank is impregnated with the ink has tended to increase with a rise of a recording frequency by the ink jet recording apparatus. When the ink amount held in the ink holding member increases more in this manner, the impact applied to the ink holding member during the falling increases. This results in an environment in which the above-described disadvantage is easily generated.

For a problem of deformation generated in the second ink holding member contained in the ink tank by the external factor, among ink tanks having various outer shapes, particularly in an ink tank in which an ink tank size of a direction substantially vertical to an abutment direction onto an ink supply tube of the ink jet head is small with respect to an ink tank size of the abutment direction, and in which a so-called aspect ratio is high with respect to the abutment direction onto the ink jet head, the second ink holding member tends to be easily deformed by the impact as compared with ink tanks having other constitutions.

Additionally, in recent years, an ink tank has been proposed in which a thermoplastic resin is used in the second ink holding member instead of urethane from viewpoints of ecology and recycling efficiency. A rebound resilience is small in the ink holding member formed of a resin material as compared with urethane. Therefore, when the ink holding member holding a large amount of ink moves or buckles by the impact during the falling, the shape of the member is not easily restored. Also in this case, in the ink tank whose aspect ratio to the abutment direction onto the ink jet head is high, the second ink holding member similarly tends to be easily deformed as compared with the ink tanks having other constitutions.

SUMMARY OF THE INVENTION

An object of the present invention is to provide an ink tank in which an ink tank size of a direction substantially vertical to an abutment direction onto an ink supply tube of an ink jet head is small with respect to an ink tank size of the abutment direction, a so-called aspect ratio to the abutment direction onto the ink jet head is large, deformation of an ink holding member can be suppressed as much as possible even with a large external impact applied to the ink tank, a mounting state onto the ink jet head is satisfactory, and an ink can steadily be supplied.

To achieve the object, according to the present invention, there is provided an ink tank which is constituted to be attachable/detachable with respect to an ink jet head, which stores an ink to be supplied to the ink jet head, and in which an ink tank size of a direction substantially vertical to an abutment direction onto an ink supply tube of the ink jet head is small with respect to an ink tank size of the abutment direction, and a so-called aspect ratio to the abutment direction onto the ink jet head is high, the ink tank comprising:

an ink supply port connected to the ink supply tube disposed in the ink jet head;

an atmosphere communicating portion which connects the inside of the ink tank to atmospheric air; and an ink holding member which holds the ink to be supplied to the ink jet head, wherein the ink holding member is constituted by a structure material which constitutes the ink holding member and contains direction components, the ink holding member includes a first ink holding member which is disposed in an ink supply port portion and in which the direction components of the structure material are arranged along a side surface with the ink supply port disposed therein, and a second ink holding member which is connected to the first ink holding member and disposed in a main region inside the ink tank, and in which the direction components of the structure material are arranged in a direction extending toward the side surface with the ink supply port disposed therein, and the first ink holding member has a relatively high ink holding force with respect to the second ink holding member.

Here, both the first and second ink holding members are foam materials in a preferable constitution. Moreover, both the first and second ink holding members are aggregates of fibers in another preferable constitution. Each aggregate of fibers is formed of a thermoplastic resin in the preferable constitution. The aggregate of fibers is formed of a polyolefin-based resin in the preferable constitution. A constituting material of an outer housing constituting the ink tank is formed of a polyolefin-based resin in the preferable constitution. The first and second ink holding members comprise a combination of a foam material constituting one of the first and second ink holding members and an aggregate of fibers constituting the other ink holding member in the preferable constitution. A fiber diameter of the fiber aggregate constituting the first ink holding member is not more than a fiber diameter of the fiber aggregate constituting the second ink holding member in the preferable constitution.

According to the constitution, for the ink tank in which the aspect ratio with respect to the abutment direction onto the ink jet head is high as described above, the ink holding member is contained such that a foaming direction or a fiber direction of the contained ink holding member extends along a height direction of the ink tank. When an external impact such as falling is applied, and particularly even when the ink tank falls with a supply port side thereof directed downwards, the foaming direction or the fiber direction extends along an external impact direction. Therefore, a strength of the ink holding member can be raised, the second ink holding member is not easily deformed, and various disadvantages resulting from the falling are not easily generated.

Moreover, since a press force is received via the ink receiving port, the first ink holding member has a directionality such that the member is easily deformed. Therefore, an excessive press force is not added to the second ink holding member, and the member is inhibited from being deformed in the constitution. The ink is steadily held in the ink holding member, and an inadvertent ink residual during ink supply, ink leak during environmental change, and ink supply defect by deviation of the second ink holding member in the housing during falling can be prevented.

Furthermore, according to the present invention, there is provided an ink tank for use in an ink jet recording apparatus, in which an ink holding member for holding an ink is contained in a housing, the ink holding member including: a first ink holding member which is disposed in at least an ink supply port portion for supplying the ink to an ink jet head to discharge the ink, and which abuts on an ink receiving port of the ink jet head to form an ink channel to supply the ink in the ink tank to the ink jet head; and a second ink holding member which contacts the first ink holding member, and supplies the ink to the first ink holding member, and in which a liquid holding force with respect to a liquid to be held is weaker than that of the first ink holding member in at least a state of the ink receiving port connected to the first ink holding member, wherein the ink holding member has a directionality including a direction in which it is easy to deform the ink holding member against a press force applied from the outside and a direction in which it is more difficult to deform the ink holding member than in the easy-to-deform direction, the first ink holding member is disposed so that the easy-to-deform direction of the first ink holding member is substantially parallel to a pressing direction of the press force extending substantially in parallel to an abutment direction of the first ink holding member onto the ink receiving port, and the second ink holding member is disposed so that the difficult-to-deform direction of the second ink holding member is substantially parallel to the pressing direction.

In the ink tank constituted as described above according to the present invention, the first ink holding member is easily deformed in the pressing direction, whereas the second ink holding member is not easily deformed in the pressing direction. Therefore, in a state in which the ink receiving port of the ink jet head is connected to the first ink holding member, that is, in a state in which the first ink holding member is held between the ink receiving port and the second ink holding member, when the press force is received via the ink receiving port, the first ink holding member is largely deformed, and the second ink holding member is inhibited from being deformed.

Moreover, in the ink tank of the present invention, for the ink holding member charged in the housing, a capillary force as a liquid holding force may be weaker in the second ink holding member than in the first ink holding member.

Furthermore, at least one of the ink holding members of the ink tank according to the present invention may be formed of a fiber material.

Additionally, in the ink tank of the present invention, the fiber diameter of the fiber material constituting the first ink holding member may be not more than the fiber diameter of the fiber material constituting the second ink holding member.

Moreover, in the ink tank of the present invention, the fiber material may be formed of a thermoplastic resin, the ink holding member may be formed of a polyolefin-based resin, and the constituting material of the housing may be formed of the polyolefin-based resin.

According to the present invention, there is provided an ink tank for use in an ink jet recording apparatus, in which an ink holding member, formed of a fiber lump, for holding the ink is contained in a housing, the ink holding member including: at least a first ink holding member which is disposed in an ink supply port portion for supplying the ink to an ink jet head to discharge the ink, and which abuts on an ink receiving port of the ink jet head to form an ink channel to supply the ink in the ink tank to the ink jet head; and a second ink holding member which contacts the first ink holding member, and supplies the ink to the first ink holding member, and in which a liquid holding force with respect to a liquid to be held is weaker than that of the first ink holding member in at least a state of the ink receiving port connected to the first ink holding member, wherein the first ink holding member is disposed so that a main fiber direction is substantially vertical to a pressing direction of a press force extending substantially in parallel to an abutment direction of the first ink holding member onto the ink receiving port, and the second ink holding member is disposed so that the main fiber direction is substantially parallel to the pressing direction.

In the ink tank constituted as described above according to the present invention, the first ink holding member formed of the fiber lump is disposed so that the main fiber direction is vertical to the pressing direction. The first ink holding member as the fiber lump has a small rigidity in the pressing direction, and is therefore easily deformed. On the other hand, the second ink holding member is disposed so that the main fiber direction of the second ink holding member is parallel to the pressing direction. The rigidity of the second ink holding member as the fiber lump in the pressing direction is higher than that of the first ink holding member. Therefore, the second ink holding member is not easily deformed as compared with the first ink holding member. Therefore, in the state in which the ink receiving port of the ink jet head is connected to the first ink holding member, that is, in the state in which the first ink holding member is held between the ink receiving port and the second ink holding member, when the press force is received via the ink receiving port, the first ink holding member is largely deformed, and the second ink holding member is inhibited from being deformed.

DESCRIPTION OF THE PREFERRED EMBODIMENTS

Embodiments of the present invention will next be described with reference to the drawings.

An ink jet cartridge to which the present invention can be applied will be described with reference to FIGS. 1 to 3A though 3C and FIGS. 4A to 4C.

Figure 1:
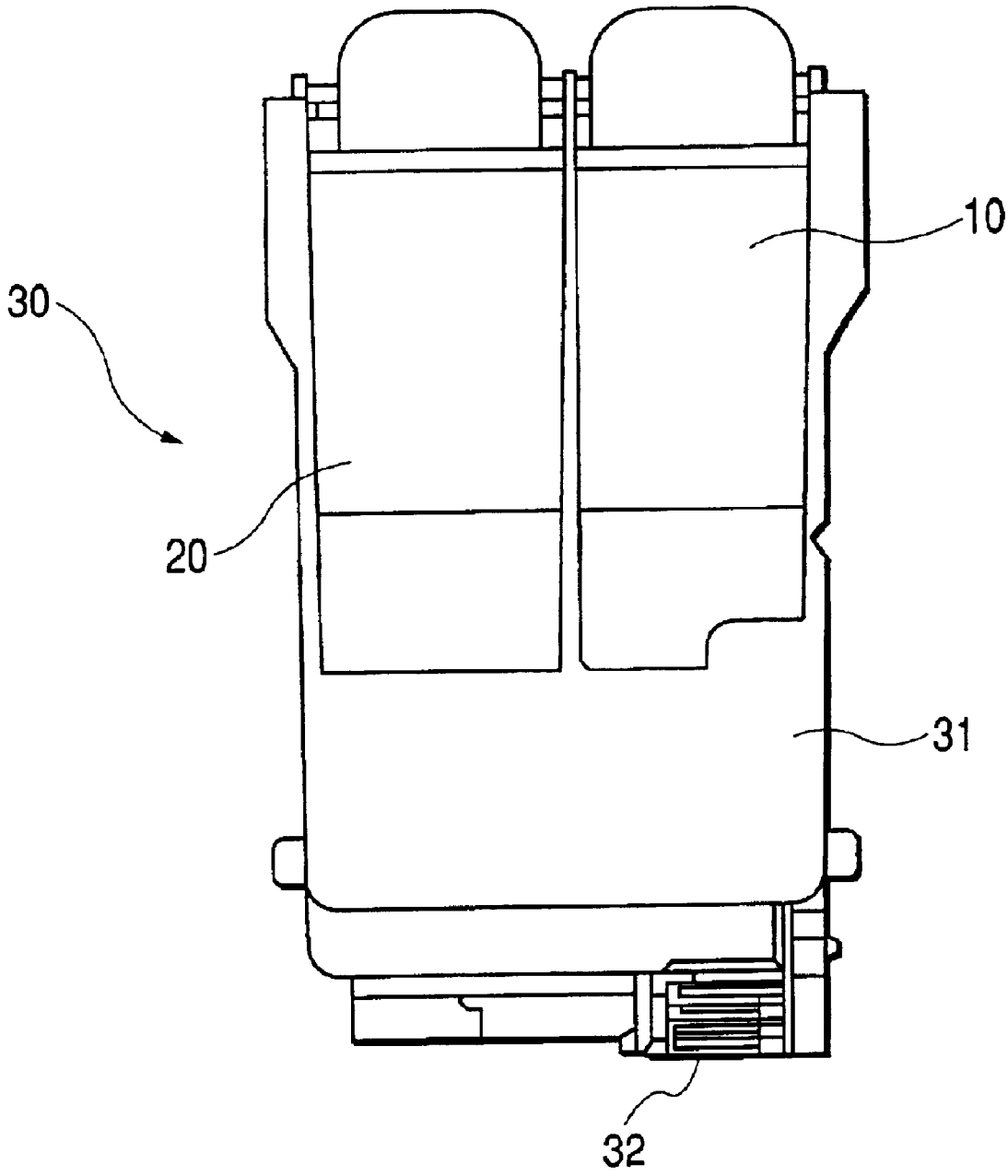
FIG. 1 is a front view of an ink jet cartridge according to a first embodiment of the present invention.

FIG. 1 is a front view of the ink jet cartridge to which the present invention can be applied. As shown in FIG. 1, an ink jet cartridge 30 has a holder 31 in which an ink jet head 32 for discharging an ink is integrally disposed, and a black ink tank 10 and color ink tank 20 held to be attachable/detachable with respect to the holder 31. The black ink tank 10 and color ink tank 20 contain inks to be supplied to the ink jet head 32, the black ink tank 10 contains a black ink, and the color ink tank 20 contains three-color inks including yellow, cyan, and magenta.

The ink jet head 32 is positioned in the bottom of the holder 31 in a used state, and has a discharge for the black ink, discharge for the yellow ink, discharge for the cyan ink, and discharge for the magenta ink (not shown) for the respective color inks supplied from the black ink tank 10 and color ink tank 20. In the holder 31, ink receiving tubes (not shown) for the respective ink colors are disposed to project from connection portions with the black ink tank 10 and color ink tank 20, respectively. Each inks receiving tube is connected to the corresponding discharge via each inks supply channel.

When the black ink tank 10 is mounted on the holder 31, the black ink in the black ink tank 10 is supplied to the discharge for the black ink via the ink receiving tube and ink supply channel. Similarly, when the color ink tank 20 is mounted on the holder, each color inks in the color ink tank is supplied to the discharge for the corresponding color via the ink receiving tube and ink supply channel.

Additionally, filters are attached to the tip ends of the respective ink receiving tubes in order to prevent foreign particles from entering the ink receiving tubes.

Figure 2:
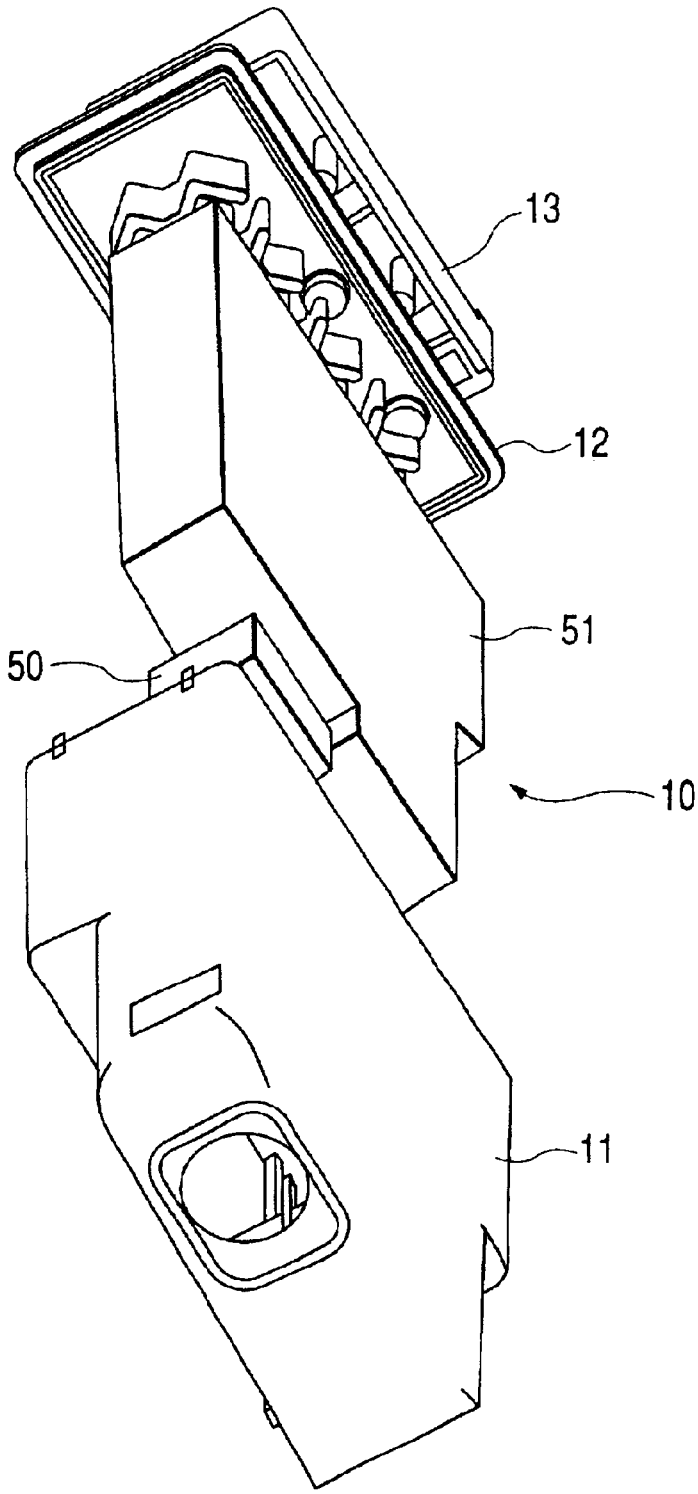
FIG. 2 is an exploded perspective view of a black ink tank shown in FIG. 1 as seen from below.

FIG. 2 is an exploded perspective view of the black ink tank shown in FIG. 1 as seen from below.

Figure 3A:
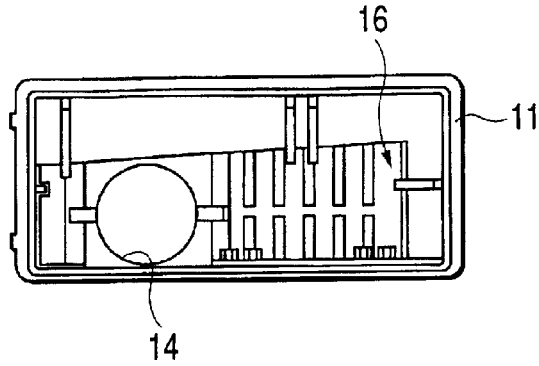
FIGS. 3A, 3B, 3C are a top plan view, partially cut side view, and bottom view of the black ink tank shown in FIG. 1.
Figure 3B:
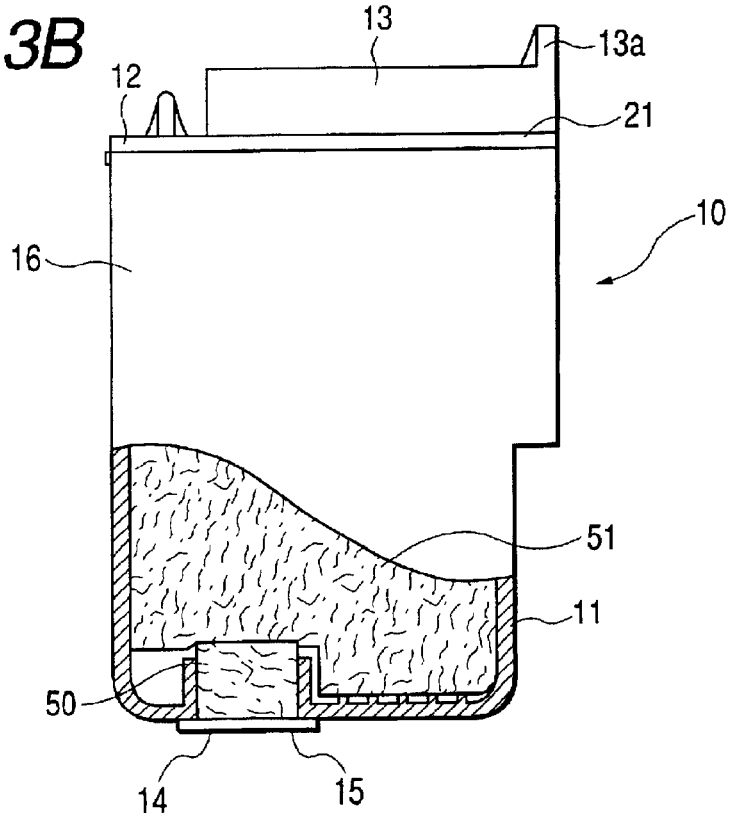
Figure 3C:
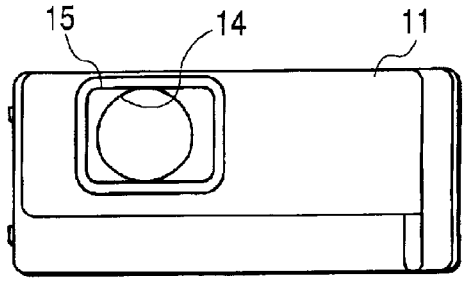
Figure 4A:
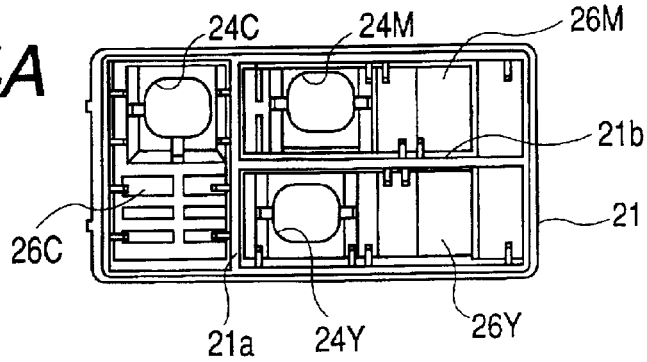
FIGS. 4A, 4B, 4C are a top plan view, partially cut side view, and bottom view of a color ink tank.
Figure 4B:
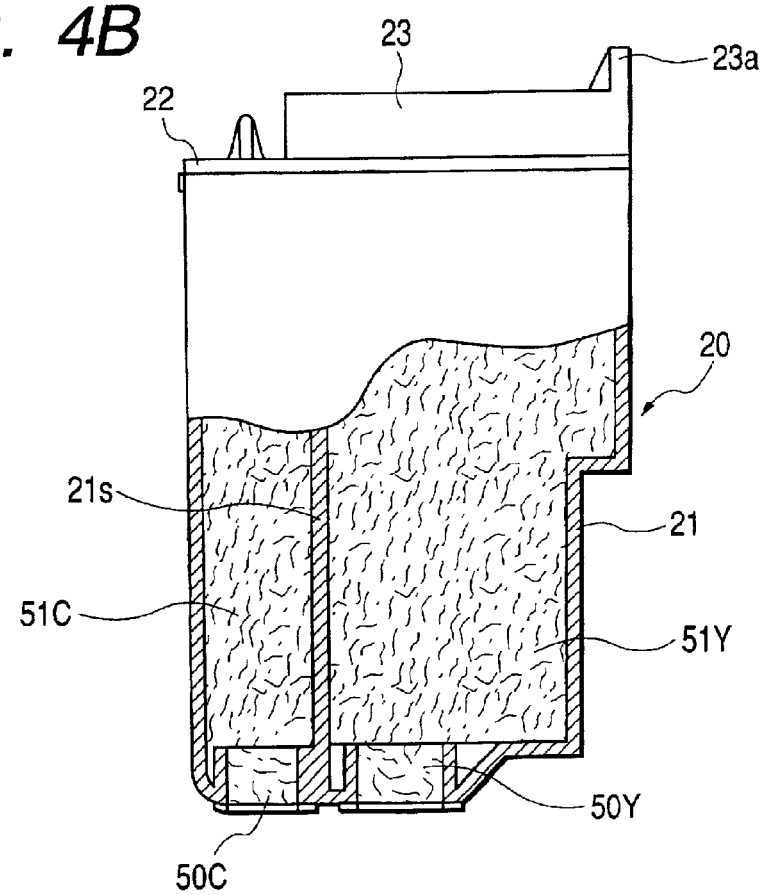
Figure 4C:
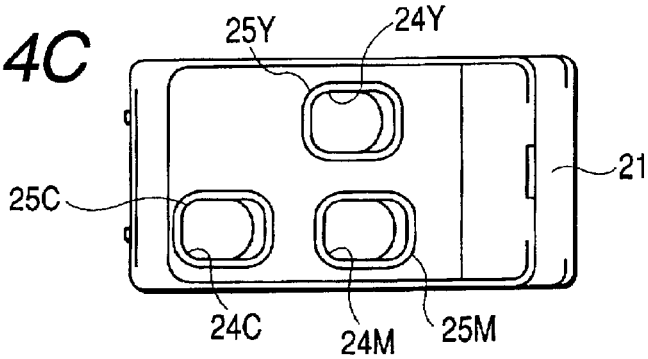

FIGS. 3A, 3B, 3C are diagrams showing the black ink tank, FIG. 3A is a top plan view, FIG. 3B is a partially cut side view, and FIG. 3C is a bottom plan view. Additionally, FIG. 3A shows a state in which a lid member and ink absorbing material are removed.

The black ink tank 10 has a housing 11 whose upper end constituting an ink containing portion 16 for the black ink is an opening, a lid member 12 which closes the upper-end opening of the housing 11 and in which an atmosphere communicating port (not shown) is formed, and an upper member 13 with which the atmosphere communicating port of the lid member 12 is covered and in which a space for buffer is disposed to prevent the ink leaking via the atmosphere communicating port from leaking to the outside. In the upper member 13, an atmosphere release port (not shown) is formed in a position different from the position of the atmosphere communicating port of the lid member 12, and a picking portion (not shown) for use in attaching/detaching the tank with respect to the holder 31 (see FIG. 1) is disposed. As shown in FIG. 3B, the black ink tank is an ink tank with an outer shape which is constituted to be high for a width of a bottom surface and which has a high aspect ratio.

In the bottom of the housing 11, an ink supply port 14 is formed in a position opposite to the ink receiving tube for the black ink of the holder 31, when the black ink tank 10 is mounted onto the holder 31. A rib 15 for preventing the ink supplied from the black ink tank 10 through the ink receiving tube from leaking into the holder 31 is formed around the ink supply port 14.

In the ink containing portion 16, a first ink holding member 50 and second ink holding member 51 for holding the black ink so that the members are impregnated with the ink are charged. The first ink holding member 50 is disposed between the second ink holding member 51 and the bottom wall of the black ink tank 10 so as to closely adhere to the second ink holding member 51 and to close the ink supply port 14 from the inside.

The first ink holding member 50 and second ink holding member 51 holds the ink so that the members are impregnated with the ink, and an ink holding force (capillary force) of the first ink holding member 50 is higher than an ink holding force of the second ink holding member 51. Thereby, the ink held in the second ink holding member 51 is effectively guided into the first ink holding member 50, and consumption efficiency of the ink held in the second ink holding member 51 is enhanced.

The first and second ink holding members 50, 51 are preferably ink holding members formed of urethane. Here, as disclosed in Japanese Utility Model Laid-Open No. 5-692, it is known that urethane has a direction with respect to foam, a rigidity of a foaming direction is higher than a rigidity of a direction substantially vertical to the foaming direction, and therefore urethane has a property that urethane is not easily deformed by a force applied in the foaming direction.

Figure 5A:
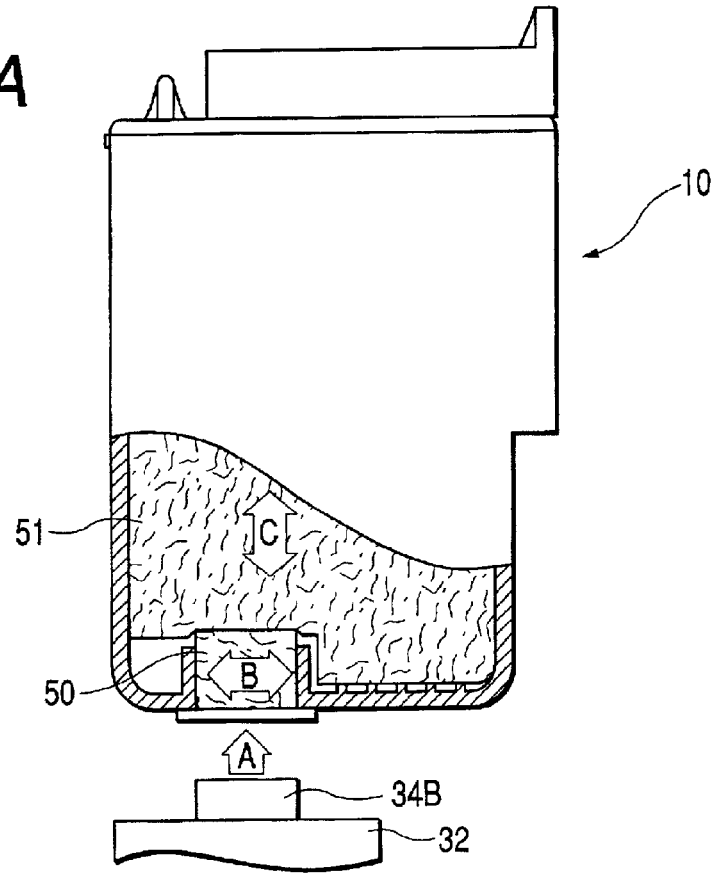
FIGS. 5A, 5B are diagrams showing a state of first and second ink holding members, when an ink jet head is bonded to the black ink tank of the first embodiment according to the present invention.

Here, as shown in FIG. 5A, the first ink holding member 50 is disposed so as to set the foaming direction of urethane to be substantially vertical (arrow B) to a pressing direction of an ink receiving tube 34B so that the member is easily deformed with respect to a press force of the pressing direction (arrow A) extending substantially in parallel to an abutment direction of the ink receiving tube 34B of the ink jet head 32. The second ink holding member 51 is disposed so as to set the foaming direction of urethane to be substantially parallel (arrow C) to the pressing direction of the ink receiving tube 34B so that the member is not easily deformed with respect to the press force of the pressing direction (arrow A) extending substantially in parallel to the abutment direction with the ink receiving tube 34B.

In other words, the second ink holding member 51 is a foam material in which foaming direction components are aligned toward the bottom surface with the ink supply port 14 disposed therein. The first ink holding member 50 is a foam material in which the foaming direction components are arranged in a direction parallel to the bottom surface with the ink supply port 14 disposed therein.

Moreover, the second ink holding member 51 is constituted to be a little larger than the housing 11 so that the first ink holding member 50 is fixed not to move inside the black ink tank 10. On the other hand, the first ink holding member 50 is constituted to be a little smaller than the housing 11 so that the member is quickly deformed and slides during abutment on the ink receiving tube 34B. Therefore, the first ink holding member 50 is constituted to be more or less compressed by the second ink holding member 51, and the ink is steadily held in the first ink holding member 50.

The foaming direction of the ink holding member contained in this manner is set as described above. When the external impact such as the falling is applied, particularly even when the ink tank falls with a supply port side directed downwards, in consideration of the foaming direction, the strength of the second ink holding member 51 particularly easily influenced can be raised. Mainly the second ink holding member which fulfils a function of holding the ink is not easily deformed, and various disadvantages accompanied by the falling are not easily generated.

When the black ink tank 10 is mounted onto the holder 31, the ink receiving tube abuts on the first ink holding member 50 in the ink supply port 14, and the ink held in the first ink holding member 50 is supplied to the discharge of the ink jet head 32 via the ink receiving tube and ink supply channel.

The color ink tank 20 will next be described with reference to FIGS. 4A, 4B, 4C. FIGS. 4A, 4B, 4C are diagrams showing the color ink tank shown in FIG. 1, FIG. 4A is a top plan view, FIG. 4B is a partially cut side view, and FIG. 4C is a bottom plan view. Additionally, FIG. 4A shows the state in which the lid member and ink absorbing material are removed.

The color ink tank 20 has a constitution basically similar to the constitution of the black ink tank 10, and has a housing 21 in which the ink is contained, a lid member 22 in which the atmosphere communicating port (not shown) is formed, and an upper member 23 attached to the lid member 22.

The inside of the housing 21 is partitioned in three regions corresponding to positions of the ink receiving tubes of the holder 31 by partition walls 21*a*, 21*b* arranged substantially in a T shape as viewed on a plane. These three regions are an ink containing portion for the yellow ink 26Y, ink containing portion for the cyan ink 26C, and ink containing portion for the magenta ink 26M. The atmosphere communicating ports of the lid member 22 are disposed in the respective ink containing portions 26Y, 26C, 26M.

In the bottom of the housing 21, ink supply ports 24Y, 24C, 24M are formed in positions opposite to the respective ink receiving tubes for the color ink when the color ink tank 20 is mounted onto the holder 31, and ribs 25Y, 25C, 25M for preventing ink leak are formed around the ink supply ports.

Moreover, in the respective ink containing portions 26Y, 26C, 26M, first ink holding members 50Y, 50C, 50M and second ink holding members 51Y, 51C, 51M are disposed so that the predetermined color inks are held and the members are impregnated with the inks. A supply operation of the inks from these constitutions and the respective ink containing portions 26Y, 26C, 26M are similar to that of the black ink tank 10, and the detailed description thereof is omitted. Also in the color ink tank 20, each of the ink containing portions 26Y, 26C, 26M has the constitution of the ink containing portion having the outer shape which is set to be high with respect to the width of the bottom surface and which has a high aspect ratio. The foaming direction of the ink holding member to be contained is disposed with respect to the ink tank which has a high aspect ratio as described concerning the black ink tank. When the external impact such as the falling is applied, particularly even when the ink tank falls with the supply port side directed downwards, in consideration of the foaming direction, the strength of the second ink holding member 51 particularly easily influenced can be raised. Mainly the second ink holding member which fulfils a function of holding the ink is not easily deformed, and various disadvantages accompanied by the falling are not easily generated.

A relation between the first and second ink holding members during the connection of the ink jet head to the ink tank will next be described with reference to the side sectional view of the ink tank shown in FIGS. 5A, 5B. Additionally, in the following description, for simplicity, particularly the black ink tank 10 will be described as an example, but the color ink tank can similarly be described.

Figure 5B:
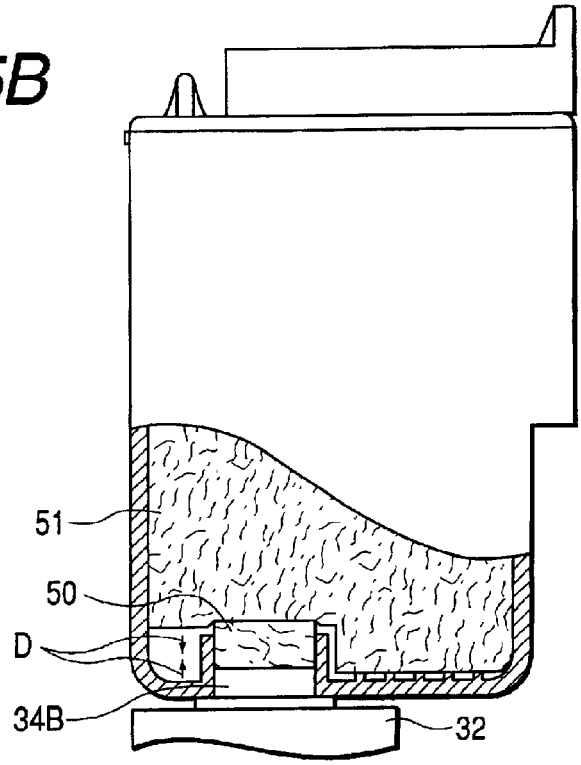

In the black ink tank 10, a state of FIG. 5A in which the black ink tank 10 is not connected to the ink jet head 32 is changed to a state of FIG. 5B in which the black ink tank 10 is bonded to the ink jet head 32. Then, a state is obtained in which the ink receiving tube 34B presses the first ink holding member 50.

That is, in this pressed state, when the ink receiving tube 34B advances into the ink supply port 14, a force for pushing the first ink holding member 50 into the second ink holding member 51 is applied to the first ink holding member 50. On the other hand, for the first ink holding member 50, the foaming direction of urethane is disposed substantially vertically (arrow B) to the pressing direction of the ink receiving tube 34B (in other words, urethane is disposed with the foaming direction parallel to the bottom surface with the ink supply port disposed therein) so that the first ink holding member is easily deformed with respect to the press force of the pressing direction (arrow A) substantially parallel to the abutment direction of the ink receiving tube 34B. Therefore, the first ink holding member positively contracts in an arrow D direction. Thereby, an approach amount of the ink receiving tube 34B into the ink supply port 14 is absorbed by the first ink holding member 50, inadvertent deformation of the second ink holding member 51 is suppressed, and the first ink holding member 50 can be allowed to abut on the ink receiving tube 34B. In this case, in the usual state (the state of FIG. 5A) in which the ink receiving tube 34B does not abut on the second ink holding member 51, the first ink holding member 50 is further compressed, the ink holding force is raised, and the ink can more steadily be held.

As described above, the ink holding members such as urethane having the foaming direction are contained in the ink tank in which the ink tank size of the direction substantially vertical to the abutment direction is small with respect to the ink tank size of the abutment direction of the ink jet head with the ink supply tube and the so-called aspect ratio with respect to the abutment direction onto the ink jet head is high in the relation shown in FIGS. 5A, 5B. Thereby, the unnecessary deformation of the second ink holding member 51 in the ink tank is suppressed, while the ink jet head 32 can be connected to the ink tank. Therefore, the ink in the ink tank is steadily held in the ink holding member, and the inadvertent ink residual during the ink supply, ink leak during the environmental change, and the ink supply defect by the deviation of the second ink holding member 51 in the housing 11 during the falling can be prevented.

Additionally, the first embodiment has been described using the first and second ink holding members 50, 51, but the materials of the first and second ink holding members 50, 51 are not limited to urethane.

Moreover, the inks to be held are not limited to Bk, Y, M, C inks for general use in the ink jet recording apparatus.

Second Embodiment

The ink tank of a second embodiment is similar to the first embodiment except that first and second ink holding members 150 and 151 are constituted of a fiber formed of a polyolefin-based resin material, and a housing 111 is similarly constituted of a polyolefin resin. Similarly as the first embodiment, in the constitution of the second embodiment, the ink tank is used in which the ink tank size of the direction substantially vertical to the abutment direction is small with respect to the ink tank size of the abutment direction of the ink jet head with the ink supply tube and the so-called aspect ratio with respect to the abutment direction onto the ink jet head is high. Therefore, the detailed description is omitted.

Additionally, in the second embodiment, the ink holding force (capillary force) of the first ink holding member 150 is preferably set to be not less than the ink holding force of the second ink holding member 151. In this case, it is preferable that the fiber having a fiber diameter smaller than that of the second ink holding member 151 is used in the first ink holding member 150. Then, the ink holding force is raised, while flow resistance components during the ink supply can be suppressed.

Figure 6A:
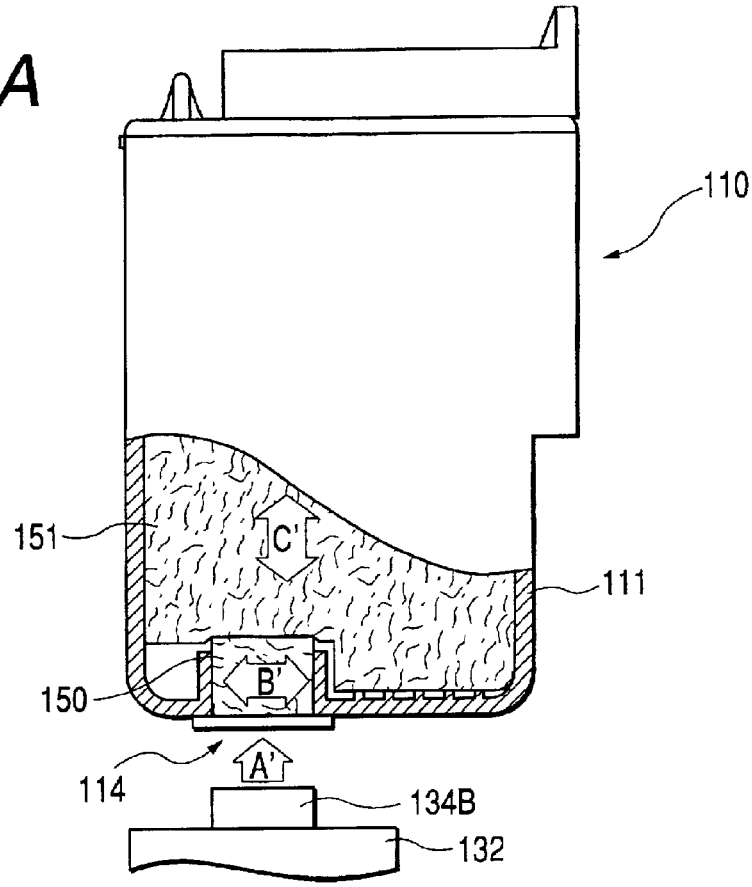
FIGS. 6A, 6B are diagrams showing the state of first and second ink holding members, when the ink jet head is bonded to the black ink tank of a second embodiment according to the present invention.

For the first ink holding member 150, as shown in FIG. 6A, the main fiber direction is disposed in the direction substantially vertical (arrow B') to the pressing direction of an ink receiving tube 134B so that the member is easily deformed with respect to the press force of the pressing direction (arrow A') substantially parallel to the abutment direction of the ink receiving tube 134B. For the second ink holding member 151, the main fiber direction is disposed in the direction (arrow C') substantially parallel to the pressing direction with the ink receiving tube 134B so that the member is not easily deformed with respect to the press force of the pressing direction substantially parallel to the abutment direction onto the ink receiving tube 134B.

In other words, the second ink holding member 151 is a fiber aggregate in which the fibers are substantially aligned toward the bottom surface with an ink supply port 114 disposed therein. The first ink holding member 150 is a fiber aggregate in which the fibers are substantially arranged in the direction parallel to the bottom surface with the ink supply port 114 disposed therein.

Figure 6B:
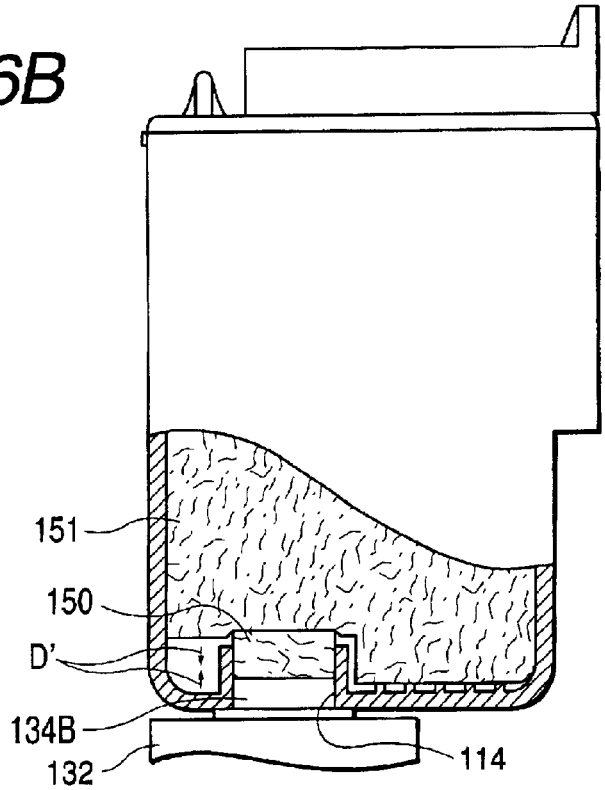
Figure 7A:
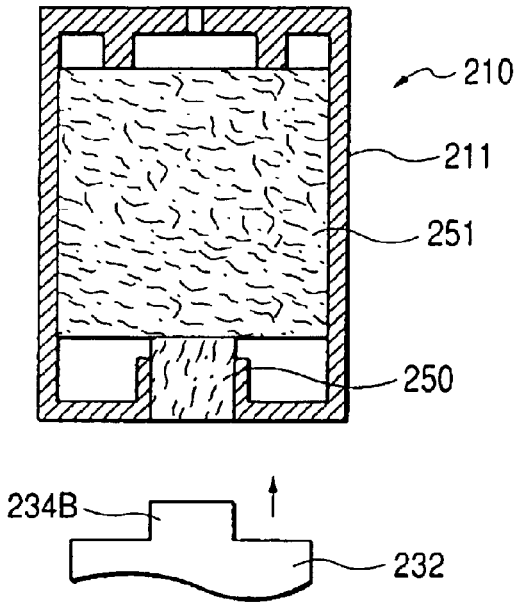
FIG. 7A PRIOR ART
FIGS. 7A, 7B are a schematic side sectional view showing one example of a constitution of a conventional ink tank, and a schematic diagram showing the state of first and second ink holding members, when the ink jet head is bonded to the ink tank.
Figure 7B:
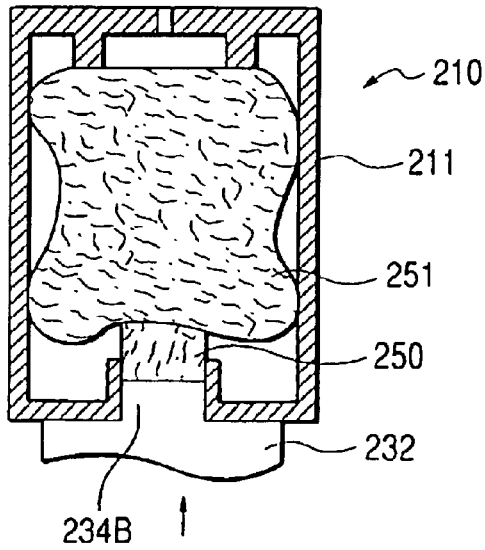
FIG. 7B PRIOR ART

For a black ink tank 110, as shown in FIG. 6B, when the black ink tank 110 is bonded to an ink jet head 132, the approach amount of the ink receiving tube 134B advancing into the ink supply port 114 is absorbed by the first ink holding member 150 positively contracting in an arrow D' direction. Therefore, the inadvertent deformation of the second ink holding member 151 is suppressed and the second ink holding member 151 can be allowed to abut on the ink receiving tube 134B.

The black ink tank in which the ink holding member constituted using the fiber having the directionality is contained has an ink tank constitution with the outer shape in which the height direction as the abutment direction onto the ink supply tube is high with respect to the width of the bottom surface and the aspect ratio is high. The arrangement direction of the fibers of the ink holding member constituted by the fibers to be contained is set with respect to the ink tank as shown in FIGS. 6A, 6B. When the external impact such as the falling is added, particularly when the ink tank falls with the supply port side directed downwards, in consideration of the arrangement direction of the fibers, the strength of the particularly easily influenced second ink holding member 151 can be raised. Therefore, the second ink holding member which mainly fulfils a function of holding the ink is not easily deformed, and various disadvantages accompanied by the falling are not easily generated.

As described above, for the ink tank of the second embodiment, similarly as the first embodiment, the unnecessary deformation of the second ink holding member 151 in the ink tank is suppressed, while the ink jet head 132 can be connected to the ink tank. Therefore, the ink in the ink tank is steadily held in the ink holding member. Additionally, the inadvertent ink residual during ink supply, ink leak during environmental change, and ink supply defect by deviation of the second ink holding member 151 in the housing 111 during falling can be prevented.

When the fiber diameter of the fiber material constituting the first ink holding member is set to be not more than the fiber diameter of the fiber material constituting the second ink holding member, the capillary force of the first ink holding member can be set to be larger than the capillary force of the second ink holding member.

Moreover, the fiber material is formed of the thermoplastic resin, particularly the polyolefin-based resin. The constituting material of the housing of the ink tank is also formed of the polyolefin-based resin.

As described above, since the housing 111 of the ink tank according to the second embodiment is constituted of the same type of the resin material as that of the first and second ink holding members 150 and 151, recycling efficiency and reusability can largely be enhanced. There can be provided an ecological ink tank.

The black ink tank has been described above as an example, but the color ink tank can also similarly be described.

Moreover, in the above-described embodiments, the first and second ink holding members are constituted by a combination of the foam materials or the fiber aggregates, but the first and second ink holding members may be constituted by combining different structure materials, that is, by combining the foam material and fiber aggregate. For example, even the combination of the first ink holding member of the fiber aggregate with the second ink holding member of the foam material, or even the reverse combination can be in the category of the present invention, as long as the viewpoint of the directionality of the structure material is satisfied.

Furthermore, an example in which the abutment direction onto the ink supply tube is substantially a gravity direction in the present invention has been described. However, with a mode in which the ink tank size in the direction substantially vertical to the abutment direction is small with respect to the ink tank size of the abutment direction with the ink supply tube of the ink jet head, and in which the aspect ratio is high with respect to the abutment direction onto the ink jet head, the longitudinal direction of the ink tank may of course be changed to the horizontal direction.

Additionally, as described in the second embodiment, the structure material of the ink tank in which the first and second ink holding members were constituted of a fiber lump of the polyolefin-based resin material was used, the properties of the first ink holding member were changed, and first to fourth examples were carried out. Evaluation results of ink supply properties will be described by way of the examples. Additionally, the same reference numerals as those used in the description of the second embodiment will be used hereinafter.

In the examples, pressure loss components, presence/absence of entrainment of bubbles resulting in supply defect, and ink use-up efficiency were evaluated using the density of the first ink holding member 150 shown in Table 1 as a parameter.

TABLE 1

| | First ink holding member | | Second ink holding member | |
|---|---|---|---|---|
| | Density [g/cm$^3$] | Fiber diameter [dtex] | Density [g/cm$^3$] | Fiber Diameter [dtex] |
| First example | 0.3 | 2.2 | 0.1 | 6.7 |
| Second example | 0.2 | 2.2 | 0.1 | 6.7 |
| Third example | 0.15 | 2.2 | 0.1 | 6.7 |
| Fourth example | 0.07 | 2.2 | 0.1 | 6.7 |

Four types of ink tanks shown in Table 1 were mounted on the holders, and a tube pump was used to forcibly discharge the ink from the ink channel in the tip end of the holder via the filter at a flow rate of 5.0 g/min. In this case, the pressure loss components were studied, and it was judged whether bubbles were entrained because of supply defect.

The evaluation results are shown in Table 2.

TABLE 2

| | Pressure loss (mmAq*) | Entrainment of bubbles before use-up | Ink use-up efficiency (discharged ink amount until defoam/injected ink amount × 100 |
|---|---|---|---|
| First example | 140 | None | 70 |
| Second example | 100 | None | 75 |
| Third example | 90 | None | 77 |
| Fourth example | (65) | Present | Stop because of bubbles entrained midway |

*A specific weight of the ink was considered to be substantially the same as that of water, and the pressure loss was measured.

From the above, the effect of the present invention has been confirmed that the excessive deformation of the absorbing material is avoided, the flow resistance components during the ink supply are reduced, and the ink supply properties can be enhanced.

However, in the fourth example in which the density of the first ink holding member 150 was extremely reduced in order to further enhance the effect of the present invention, during the discharging of the ink at a high speed, a phenomenon occurred in which a recorded image was blurred during the using-up of the ink. As a result of analysis, it has been found that the phenomenon was caused by bubbles residing inside the head. This is supposedly because it was easier to entrain air from the ambient space of the first ink holding member 150 than to move the ink to the first ink holding member 150 from the second ink holding member 151, and an adequate ink supply was hindered by the entrainment of the bubbles.

Therefore, when the deformation directions of the first and second ink holding members 150 and 151 are defined, the effect of the present invention can be obtained. However, when the present invention is employed, it is preferable to appropriately select the densities, fiber diameters, and materials of the first and second ink holding members in consideration of properties of a printer.

As described above, according to the present invention, for the ink tank in which the ink tank size in the direction substantially vertical to the abutment direction is small with respect to the ink tank size of the abutment direction with the ink supply tube of the ink jet head, and in which the so-called aspect ratio is high with respect to the abutment direction onto the ink jet head, the ink holding member is contained so that the foaming direction or the fiber direction of the ink holding member to be contained extends along the height direction of the ink tank. When the external impact such as the falling, particularly even when the ink tank falls with the supply port side directed downwards, the foaming direction or the fiber direction extends along the external impact direction. Therefore, the strength of the ink holding member can be raised, the second ink holding member is not easily deformed, and various disadvantages accompanied by the falling are not easily generated.

Moreover, the press force is received via the ink receiving port, and the first ink holding member has a directionality such that the member is easily deformed. Therefore, the excessive press force is not applied to the second ink holding member and the member is inhibited from being deformed. Therefore, the ink is steadily held in the ink holding member, and the inadvertent ink residual during ink supply, ink leak during environmental change, and ink supply defect by deviation of the second ink holding member in the housing during falling can be prevented.

What is claimed is:

1. An ink tank for storing ink, which is constructed to be attachable to and detachable from an ink receiving tube as a beginning end of route introducing ink to an ink jet head, the ink tank having an outer shape oblong along a vertical direction when being used, comprising:

an ink supply port into which said ink receiving tube is inserted;

an atmosphere communicating portion which connects the inside of said ink tank to atmosphere; and a fibrous ink holding member, constructed by a fiber aggregate becoming a negative pressure source for holding ink to be supplied to the ink jet head;

wherein said fibrous ink holding member is provided with first and second fibrous ink holding members, wherein the first fibrous ink holding member is disposed to face said ink supply port and abut on the beginning end of said ink receiving tube in a mounting state of said ink tank, the first fibrous ink holding member having an outer shape smaller than said second fibrous ink holding member and being partially abutted on a part of said second ink holding fibrous member, and wherein the second fibrous ink holding member is contained in a main region in an inside space of said ink tank, wherein said first fibrous ink holding member is constructed by a fiber aggregate having an arrangement direction component crossing to a pressing direction and parallel to the abutment direction on said ink receiving tube, and said second fibrous ink holding member is constructed by a fibrous aggregate having an arrangement direction component in a direction parallel to said pressing direction and parallel to the abutment direction on said ink receiving tube;

wherein said ink supply port, said first fibrous ink holding member, and said second fibrous ink holding member have a positional relation so as to be disposed in a line on a line extending in an inserting direction of said ink receiving tube, and wherein an ink holding force of said first fibrous ink holding member is relatively higher than that of said second fibrous ink holding member.

2. The ink tank according to claim 1 wherein said fiber material comprises a thermoplastic resin.

3. The ink tank according to claim 1 wherein said fibrous ink holding member comprises a polyolefin-based resin.

4. The ink tank according to claim 1 wherein a constituting material of said housing comprises a polyolefin-based resin.

5. The ink tank according to claim 1, comprising a pipe-like member standing inward of said ink tank from said ink supply port, wherein said first fibrous ink holding member is contained in a manner that a part thereof protrudes with respect to said pipe-like member to abut on said second fibrous ink holding member.

* * * * *